United States Patent [19]

Loredo

[11] 4,413,842

[45] Nov. 8, 1983

[54] WALKING ATTACHMENT FOR ROLLER SKATES

[76] Inventor: Isidoro Loredo, 570 N. Main St., Manteca, Calif. 95336

[21] Appl. No.: 276,089

[22] Filed: Jun. 22, 1981

[51] Int. Cl.[3] ..... A63C 3/00

[52] U.S. Cl. ..... 280/825; 36/132

[58] Field of Search ..... 280/11.1 ET, 11.21, 280/11.19, 809, 825, 811, 816, 7.13, 13, 28.5, 11.1 R; 36/114–115, 132

[56] References Cited

U.S. PATENT DOCUMENTS

| | | | |
|---|---|---|---|
| 2,937,878 | 5/1960 | Reina | 280/13 |
| 3,015,492 | 1/1962 | Kesner et al. | 280/825 |
| 3,774,926 | 11/1973 | Chase | 280/13 |
| 3,861,697 | 1/1975 | Dolce | 280/825 |
| 3,898,749 | 8/1975 | Famolare, Jr. | 280/816 |
| 4,355,474 | 10/1982 | Grim | 280/825 |

*Primary Examiner*—Joseph F. Peters, Jr.
*Assistant Examiner*—Timothy Roesch
*Attorney, Agent, or Firm*—Mark C. Jacobs

[57] ABSTRACT

A skate converter adapted to receive shoe skates and which upon fastening thereto permits the wearer to walk safely in shopping malls and buildings where skate bearing persons are generally prohibited. The converter includes a sole plate and two front and rearwardly spaced apart arcuate sections all of which are covered with a treadlike material to easily grip floors and rugs.

4 Claims, 4 Drawing Figures

WALKING ATTACHMENT FOR ROLLER SKATES

BACKGROUND OF THE INVENTION

Roller skating today is a very popular past time for young and old alike. Skates have risen like a phoenix to take the place of the skate board, a wheeled device, as the popular means for transportation and recreation both as a way of travel to school and elsewhere, and as a sporting device on which kids can spend free time.

While roller skates are used by the very young, most people prefer the so called shoe skates which include a shoe, usually high sided for support, mounted on a roller skate in a non-removable fashion. Many of those recently available though good looking and comfortable, do not lend themselves for walking around safely if at all.

This invention by contrast provides for the first time an adapter or converter that permits wearers of shoe skates to easily walk around while still wearing the shoe skate thus providing safety without the necessity of carrying an extra pair of shoes with them.

Indeed the product of this invention does not require any alterations to the skate nor are special skates required to be worn by the skater.

Applicant has studied the problem of skaters in attempting to walk safely while still wearing the skates and has reviewed the prior art. One patent of which he is aware is Familere, U.S. Pat. No. 3,898,749. This pertains to a new structure, a combination skater-walker, requiring the skater to dispose of his current skates. The device herein is adaptable by contrast to any shoe skate. The only other relevant patent found was Whited U.S. Pat. No. 2,208,888 which was for an attachment to standard roller skates. That device did not provide the safety available herein and was not designed for easy removal from the skate even by a child as is the case with the instant invention.

SUMMARY OF THE INVENTION

It is an object hereof to provide a low cost easily attached shoe skate converter.

Another object is to provide a walking attachment for shoe skates that is easily removed when no longer needed.

Still another object is to provide a skate converter that is safe to wear in stores and shopping malls by people of all ages.

Yet another object is to provide a shoe skate converter that has a non-skid floor contacting surface and which is comfortable to wear.

For a fuller understanding of the nature of the device hereof and the advantage of same reference should be made to the following detailed description with reference being made to the accompanying drawings.

In accordance with the invention the converter herein is simply fit over the skate portion of the shoe skate latched front to back and that's it. Once attached, the sole means of the instant device with its non-skid surfaces provides a safe means of walking especially since the tracks are held in place in the device.

Figure 3:
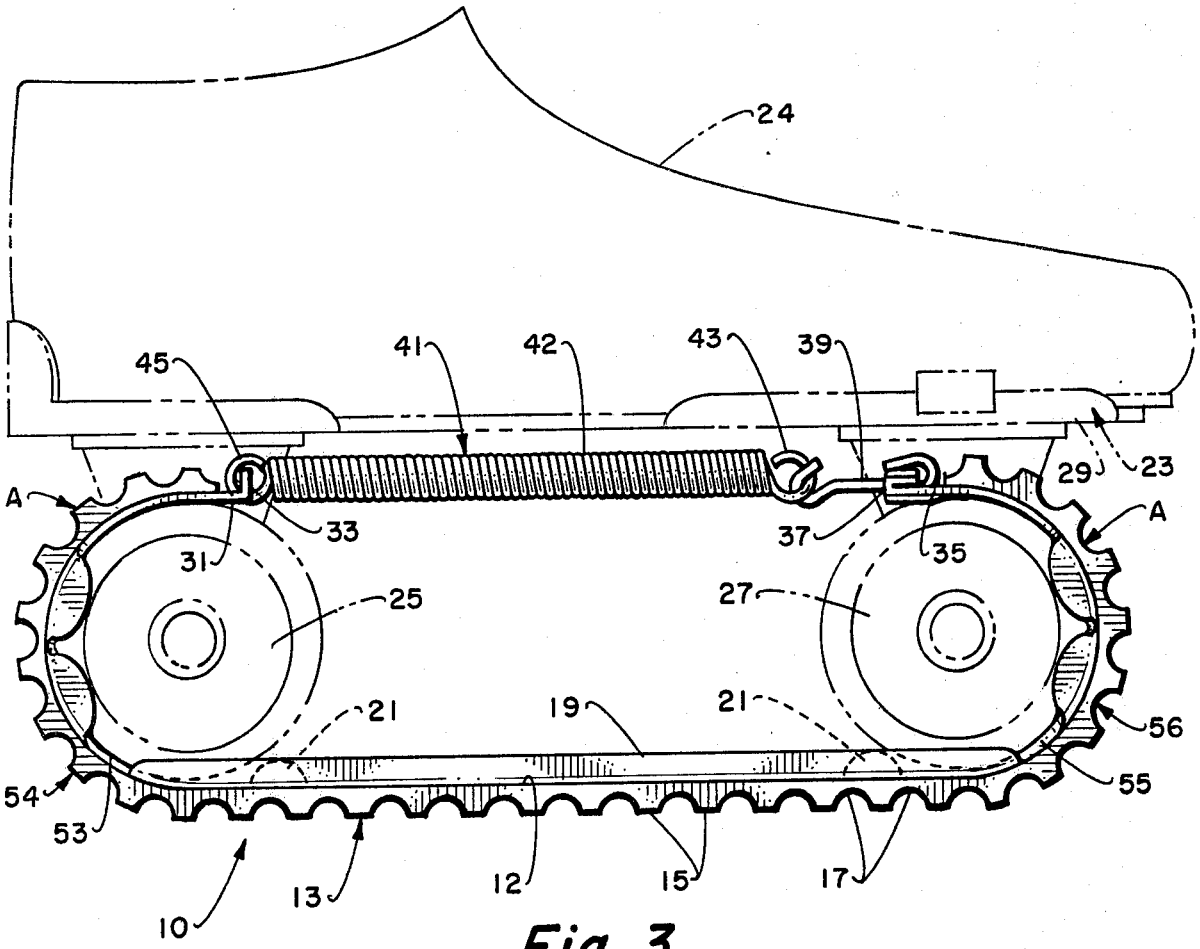
FIG. 3 is a right side elevation thereof. The left side elevation would be a mirror image thereof.

The shoe skate in FIG. 3 forms no part of the invention.

In the several figures, like numbers refer to like parts.

DESCRIPTION OF THE PREFERRED EMBODIMENT

Figure 1:
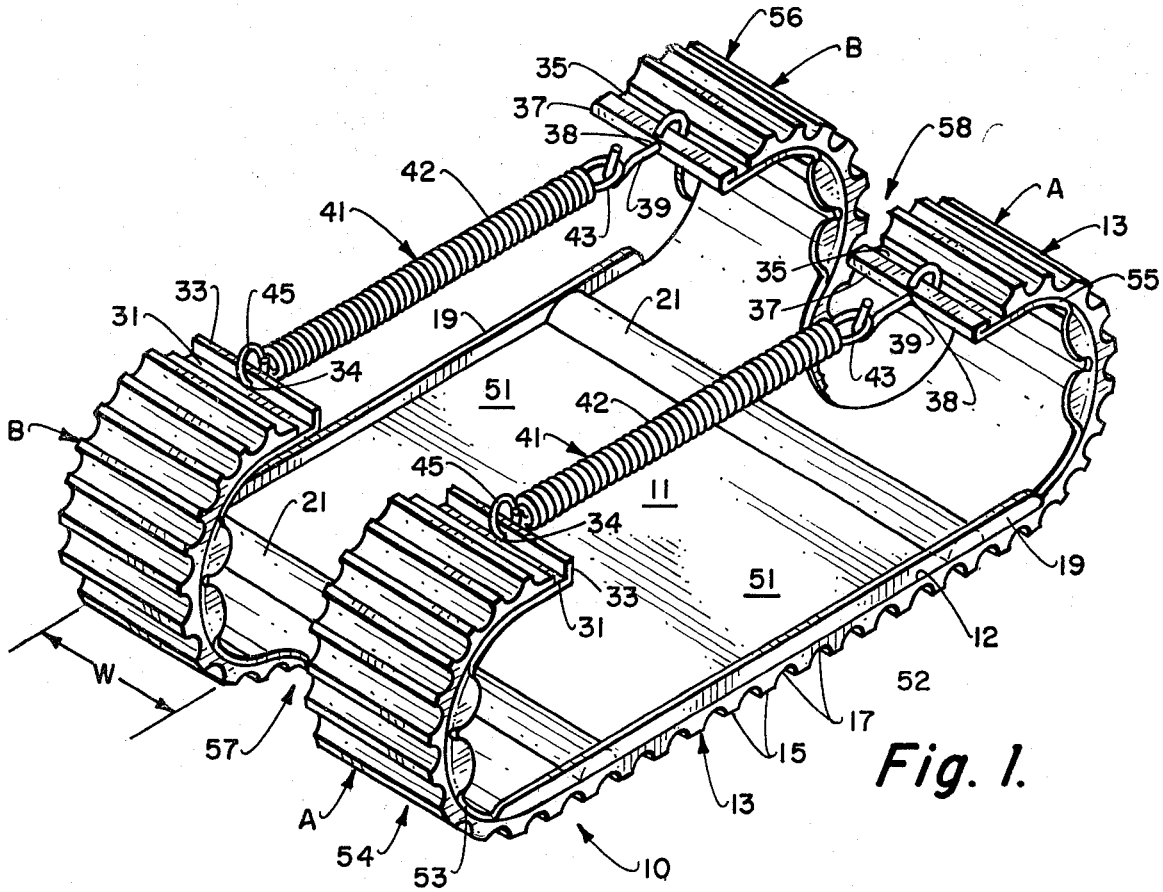
FIG. 1 is a top perspective view of the shoe skate converter of the instant invention.

Referring now to the drawings, it is seen in FIG. 1 herein the general configuration of the device of this invention. Its placement on the shoe skate is shown in FIG. 3. Referring back to FIG. 1 it is seen that the shoe skate converter 10 hereof hereinafter referred to as the converter 10 comprises a sole section 11 having a tread section 13 attached thereto on one side thereof. The other side being open and adapted to receive shoe skate 23's front and rear truck wheels 25 and 27 respectively therein (See FIG. 3).

Sole section 11 comprises a generally rectangular flat central portion 51 having upturned flanges 19 at the outside edges thereof. Extending radially, both forwardly and rearwardly therefrom are two pairs of similarly arcuate spaced apart opposite facing portions 53A and B and 55A and B. Each arcuate portion is integrally attached and is preferably a continuous appendage to the centre portion 51 and is formed therewith as one piece. The curvature of each arcuate section 53A and B, and 55A and B is intended to conform to the radius of the shoe skate truck wheel. Preferable materials are flexible metals such as aluminum or steel sheet which can be reduced or enlarged in curvature in order to accomodate wheels of differing diameters. Plastic may also be OK.

Suitably spaced apart along the length of the centre portion 11 and extending the width thereof are a pair of retainers 21. Said retainers are spaced such that the forward one is behind the lead truck, while the rearward one is ahead of the rear truck. These retainers 21 serve to prevent rotation to and fro within the device 10 during wear periods. Such retainers may be metal or plastic and if metal integral formed with sole plate 11 or attached separately by a suitable fastening means such as adhesive, solder or welding. Preferrably retainers 21 are arcuate such as not to present sharp edges to the trucks 25 and 27 which usually being of urethane elastomer are subject to nicking.

Each arcuate portion 53A and B at the top thereof includes a small $\frac{1}{8}''$ or so horizontal extension 31 that extends beyond the overlaid tread (to be discussed infra) and an upward extension flange 33. Each flange has an aperture 34 centrally located preferably for receiving coil spring hook eye 45 therein.

The front arcuate sections 55A and 55B include at the top thereof a slightly extension 35 beyond the end of the tread, and a forwardly folded over portion 37. The folded over portion has a central aperture 38 therein for receiving hook 39 therein.

Coil spring 41 includes main body coil 42, connected to an integral front eye 43, and a rear hook eye 45. Such a spring 41 is deemed conventional in the spring art. To be placed under tension the rear mounted spring is attached to the hook 39.

Figure 2:
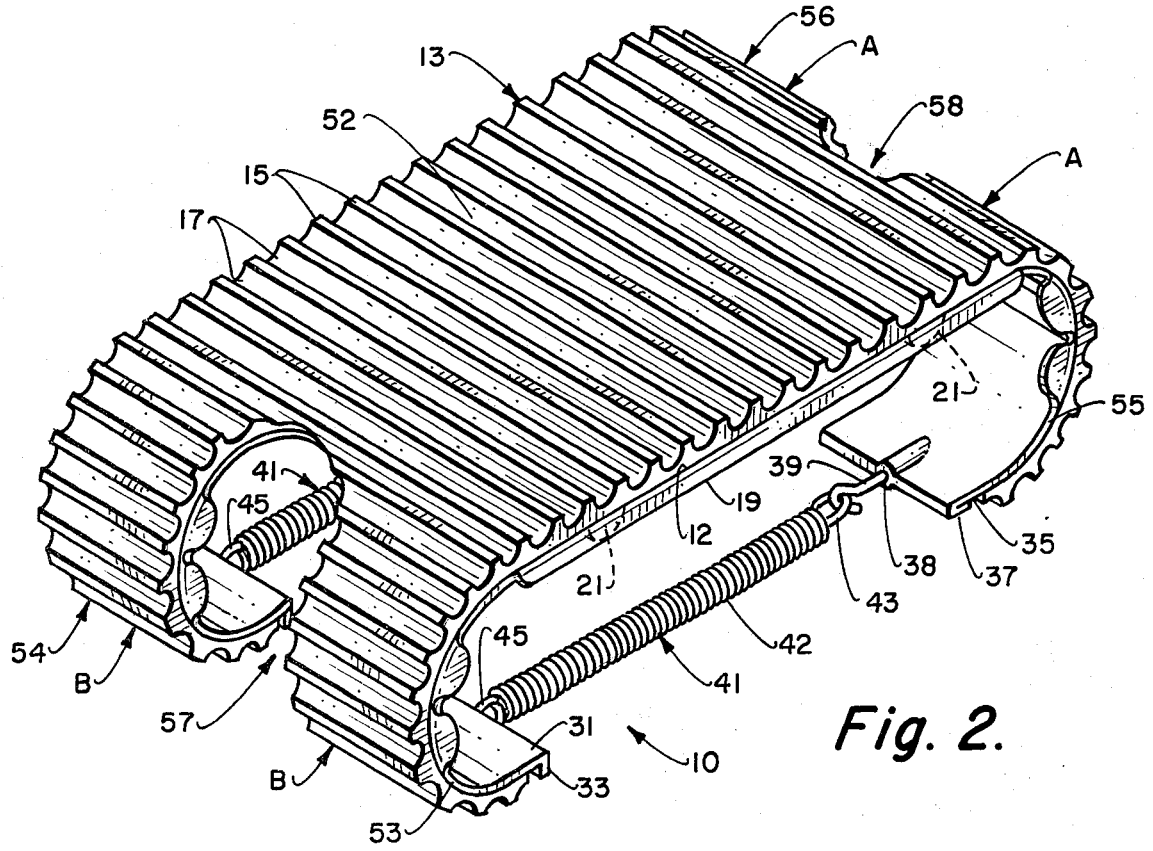
FIG. 2 is a bottom perspective view thereof.

Traction is provided to the wearer by tread section 13 which is comprised of two laterally spaced apart left tread arcuate portions 54A and B, and two right side also laterally spaced apart tread arcuate portions 56A and B interconnected by a central planar generally rectangular portion 52. The tread section 13 is sized to conform to the dimensions of the sole plate 11, and is underposed thereon by being adhered thereto on the underside 12 thereof. The tread section is formed of alternating ridges 15 and grooves 17, as is best seen in FIG. 2, which best depicts the underside of the product of this invention.

Tread 13 may be adhesed by any suitable cement or adhesive that won't degrade rubber to the surface 12 of sole plate 11.

The tread 13 provided herein yields a traction surface for control with the ground or other surface to permit the wearer to walk up and down steps, over floors or rugs, and to ride escalotors without danger to him or herself or the risk of injury to the floor or marking rug, or other patrons of the store, or to property within the store from impact therewith by the skater.

Optional inside extensions similar to 57 and 58 on sole plate 11 may be used to help retain wheels 25 and 27 in place. If custom skate wheels of a non-standardized size are used, the side extensions 57 and 58 can be cut or clipped off to accommodate special wheels wider in size, if necessary.

In the discussions above and below the terms left side and right side have been used with respect to portions 53, 54, 55 and 56. Such terminology has been employed to refer to the rearward arcuate portions 53 and 54 and the forward arcuate portions 55 and 56 due to the relative placement in both FIGS. 1 and 3, for the sake of ease and convenience of the reader.

In the embodiment shown in FIG. 1 the retainers 21 are fixedly mounted in place. The use of same for their intended purpose presupposes the placement of a standardized truck wheel 25, 27. If however, a larger wheel is employed, there may be a fit problem and if smaller, a slant situation also creating difficulty. Thus the construction of FIG. 4 would alleviate any problems, if the industry went to nonstandard wheels, or to wheels differing in size for either the front or rear trunk.

Figure 4:
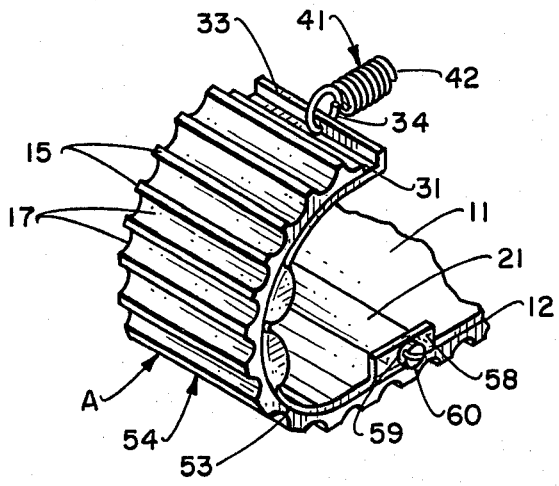
FIG. 4 is a closeup fragmented view of a portion of this invention.

In FIG. 4 retainer mount 58 would be fixedly secured on each side of the base plate in both a forward and rearward location corresponding to the general area where the retainers 21 should be disposed. Such mount 58 is an upstanding member generally rectangular and having a horizontally extending slot 59 therein. Threaded screw 60 is inserted through slot 59 into a corresponding threaded area in the width or side of each retainer. Such threads are not seen in this Figure. Tightening of the screw locks the retainer in the desired location.

Obviously the size of the retainers would be slightly less in extension, i.e. not the full width of the side plate, if the construction of FIG. 4 is to be employed, in order to provide for clearance between the retainer and the retainer mount.

It is to be noted for the above that the arcuate section can accomodate a smaller and a larger wheel up to about an $\frac{1}{8}$ of an inch deviation either way from the industry standard.

For taking off said device 10, take front wheels out first then rear wheels.

In order to utilize the device 10 of this invention, the skater inserts the rear truck's wheels 25 into the rear arcuate section of the device, and the forward wheels 27 into forward arcuate section. Care should be taken to align each wheel within the width W of its respective arcuate section. Care should also be taken to be sure that the rear wheels are behind retainer 21 and the front wheels in front of the front retainer 21.

As an aside, these retainers though shown fixed in place as members made of plastic or metal, may also be made slideally mounted with fastening means as shown in FIG. 4 as may be desired. Such FIG. 4 is discussed infra.

The spring 41 is attached to hooks 39. This has the effect of tightening the arcuate portions of device 10 into a tight abutting relationship with wheels 25 and 27. Since the curvature of the arcuate portions is preferable equal to about 180° the wheels are afixed in place in device 10. The wearer then takes normal walking steps on whatever surface he or she desires to walk upon.

Since certain changes can be made in the above apparatus while remaining within the scope of the invention, all details set forth are intended to be exemplary and as limiting the scope of the invention.

I claim:

1. An attachment to convert roller skates for walking comprising a sole plate having a top and bottom surface, said sole plate having a rearward facing forward arcuate section connected to a central generally planar section in turn connected to a forward facing rear arcuate section sized in radius to correspond to the radius of the forward section, ech arcuate section comprising a pair of spaced slightly flexible arc portions, at least the central section of said sole plate having an upstanding flange along each side thereof, a traction tread secured to the bottom surface of said sole plate, a pair of parallel forwardly and rearwardly adjustable wheel retainers mounted spaced from the arcuate sections and spaced from each, and adapted to prevent forward and rearward movement of skate trucks when said trucks are placed in the attachment, means disposed in said central section for adjustably mounting said wheel retainers, and releasable spring means for springingly connecting one arcuate section to the other arcuate section, mounted on the top of each such section.

2. In the attachment of claim 1 wherein the means for adjustably mounting each of said wheel retainers comprises a pair of opposed, upstanding, horizontally slotted retainer mounts.

3. In the attachment of claim 1 wherein the traction tread is selected from the group consisting of rubber and plastic.

4. The attachment of claim 1 wherein the tread comprises a plurality of succeeding ridges and hemispheres.

* * * * *